US009963910B2

(12) United States Patent
Lu

(10) Patent No.: US 9,963,910 B2
(45) Date of Patent: May 8, 2018

(54) LOCKING DEVICE

(71) Applicant: Xue-Qin Lu, Taoyuan (TW)

(72) Inventor: Xue-Qin Lu, Taoyuan (TW)

( * ) Notice: Subject to any disclaimer, the term of this patent is extended or adjusted under 35 U.S.C. 154(b) by 164 days.

(21) Appl. No.: 15/012,898

(22) Filed: Feb. 2, 2016

(65) Prior Publication Data

US 2016/0230420 A1 Aug. 11, 2016

(30) Foreign Application Priority Data

Feb. 5, 2015 (TW) ..... 104103903 A

(51) Int. Cl.
*E05B 19/18* (2006.01)
*E05B 19/00* (2006.01)
*E05B 17/16* (2006.01)

(52) U.S. Cl.
CPC ..... *E05B 19/18* (2013.01); *E05B 17/16* (2013.01); *E05B 19/0094* (2013.01)

(58) Field of Classification Search
CPC ..... E05B 17/16; E05B 19/00; E05B 19/0017; E05B 19/0023; E05B 19/0035; E05B 19/0041; E05B 19/0052
See application file for complete search history.

(56) References Cited

U.S. PATENT DOCUMENTS 1,573,791 A * 2/1926 Roethlisberger ..... E05B 17/16 70/395
1,696,326 A * 12/1928 Roethlisberger ..... E05B 17/16 70/372
1,728,310 A * 9/1929 Sundel ..... E05B 17/16 33/539
3,408,842 A * 11/1968 Barnes ..... E05B 17/16 70/395
4,120,184 A * 10/1978 Gerlach ..... E05B 11/00 70/389
4,161,871 A * 7/1979 Ziegler ..... E05B 27/00 70/356
4,875,352 A * 10/1989 Smallegan ..... E05B 27/00 70/395
5,950,466 A * 9/1999 Moen ..... E05B 17/16 70/395
6,272,891 B1 * 8/2001 Moen ..... E05B 17/16 70/395
6,305,200 B1 * 10/2001 Moen ..... E05B 17/16 70/395
6,397,649 B1 * 6/2002 Naber ..... E05B 17/16 40/330
7,533,550 B2 * 5/2009 Herdman ..... E05B 27/005 70/340

* cited by examiner

*Primary Examiner* — Christopher J Boswell
(74) *Attorney, Agent, or Firm* — Alan D. Kamrath; Kamrath IP Lawfirm, P.A.

(57) ABSTRACT

A locking device includes a lock, a blade and an attachment. The lock includes a key slot and a lockpin unit. The key slot extends from a key insertion face to an interior of the lock. The lock includes an inner wall. The lockpin unit is in the lock and extends into the key slot from the inner wall of the lock. The blade includes a guiding end, a control end, a receiving portion located between the guiding and control ends, and a guiding piece. The guiding piece is arranged at the guiding end. The guiding end is located in the key slot, and the control end is located outside the key slot. The attachment is detachably attached to the receiving portion. The blade is slid to drive the attachment to be in or off contact with the lockpin unit.

10 Claims, 4 Drawing Sheets

LOCKING DEVICE

CROSS REFERENCE TO RELATED APPLICATIONS

The application claims the benefit of Taiwan application serial No. 104103903, filed on Feb. 5, 2015, and the subject matter of which is incorporated herein by reference.

BACKGROUND OF THE INVENTION

1. Field of the Invention

The present invention generally relates to a locking device and, more particularly, to a locking device where the key slot of the locking device is blocked by the key to prevent viewing of the internal structure of the locking device through the key slot.

2. Description of the Related Art

A conventional locking device includes a lock and a key. The lock includes a key slot extending from a surface to the interior of the lock. When the key is inserted into the key slot of the lock, the key can access a lockpin unit of the lock to switch the lock between a locking state and an unlocking state.

In the conventional locking device, however, the structure of the lockpin unit could be figured out by viewing the internal structure of the lock through the key slot. As a result, a corresponding unlocking tool can be inserted into the key slot to unlock the locking device. Due to the exposure of the key slot, the burglarproof effect of the locking device is insufficient.

In light of this, it is necessary to provide a novel locking device with an improved burglarproof effect.

SUMMARY OF THE INVENTION

It is therefore the objective of this disclosure to provide a locking device where the key slot is blocked by the key to improve the burglarproof effect.

In an embodiment of the invention, a locking device includes a lock, a blade and an attachment. The lock includes a key slot and a lockpin unit. The key slot extends from a key insertion face to an interior of the lock. The lock includes an inner wall. The lockpin unit is in the lock and extends into the key slot from the inner wall of the lock. The blade is slidably received in the key slot and includes a guiding end, a control end, a receiving portion and a guiding piece. The receiving portion is located between the guiding end and the control end. The guiding piece is arranged at the guiding end. The guiding end is located in the key slot, and the control end is located outside the key slot. The attachment is detachably attached to the receiving portion of the blade. The sliding action of the blade controls the attachment to be in contact with the lockpin unit or not. Thus, the burglarproof effect of the locking device is improved.

In a form shown, the lock further includes a sliding groove. The blade is slidably received in the lock. A blocker is arranged in the sliding groove of the key slot. The blade further includes a limiting block. The blocker is adapted to abut against the limiting block. Thus, the burglarproof effect of the locking device is improved.

In the form shown, the blocker is located at one end of the sliding groove adjacent to the key insertion face, and the limiting block is located at the guiding end of the blade. Thus, the burglarproof effect of the locking device is improved.

In the form shown, the receiving portion is in the form of a groove. Thus, stable positioning of the attachment is attained.

In the form shown, the locking device further includes a head coupled with the control end of the blade. Thus, the utility of the locking device is improved.

In the form shown, the head is coupled with the control end of the blade in a rotatable manner. Thus, the utility of the locking device is improved.

In the form shown, the guiding piece is located outside of and adjacent to the receiving portion of the blade. Thus, the burglarproof effect of the locking device is improved.

In the form shown, the guiding piece includes an insertion guiding portion. The insertion guiding portion includes a first insertion end relatively adjacent to an end face of the guiding end, as well as a second insertion end relatively distant to the end face of the guiding end. The first insertion end is spaced from the inner wall at a first distance, and the second insertion end is spaced from the inner wall at a second distance. The first distance is larger than the second distance. Thus, the utility of the locking device is improved.

In the form shown, the guiding piece includes a withdrawal guiding portion. The withdrawal guiding portion includes a first withdrawing end relatively adjacent to the end face of the guiding end, as well as a second withdrawing end relatively distant to the end face of the guiding end. The first withdrawing end is spaced from the inner wall at a first spacing, and the second withdrawing end is spaced from the inner wall at a second spacing. The first spacing is smaller than the second spacing. Thus, the utility of the locking device is improved.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
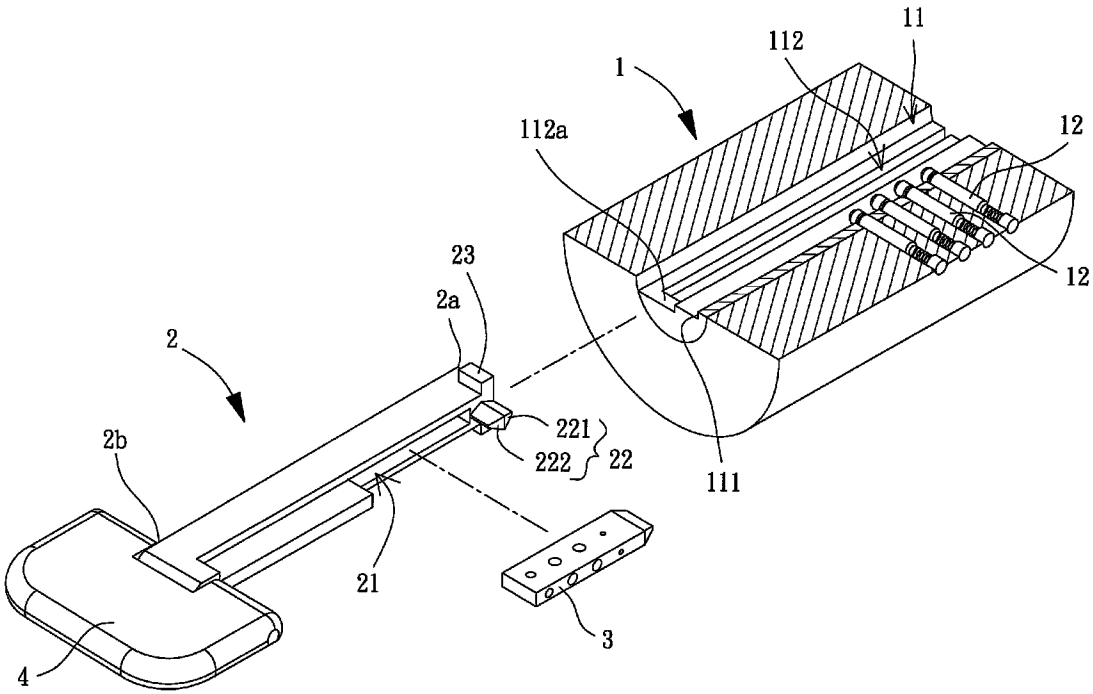
FIG. 1 is an exploded view of a locking device according to an embodiment of the invention.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the disclosure.

DETAILED DESCRIPTION OF THE INVENTION

FIG. 1 is an exploded view of a locking device according to an embodiment of the invention. The locking device includes a lock 1, a blade (or shaft) 2 and an attachment 3. The blade 2 is slidably received in the lock 1. The attachment 3 is detachably attached to the blade 2.

The lock 1 includes a key slot 11 and a lockpin unit 12. The key slot 11 extends from a key insertion face to the interior of the lock 1. The lock 1 includes an inner wall 111 and a sliding groove 112. The lockpin unit 12 is in the lock 1 and extends into the key slot 11 from the inner wall 111. A blocker 112*a* is arranged in the sliding groove 112 of the key slot 11. Preferably, the blocker 112*a* is located at one end of the sliding groove 112 adjacent to the key insertion face.

The blade 2 includes a guiding end 2*a*, a control end 2*b*, a receiving portion 21 and a guiding piece 22. The receiving portion 21 is located between the guiding end 2*a* and the control end 2*b*. The guiding piece 22 is arranged at the guiding end 2*a*. The blade 2 is slidably received in the key slot 11. The guiding end 2*a* is located in the key slot 11, and the control end 2*b* is located outside the key slot 11. Namely, the blade 2 is arranged in the key slot 11 in a manner where the blade 2 cannot be disengaged from the key slot 11. Since the blade 2 cannot be disengaged from the key slot 11, the blade 2 and the guiding piece 22 are able to block the key slot 11, preventing someone with malicious intention from viewing the internal structure of the lock 1 via the key slot 11, or preventing the insertion of an unlocking tool into the key slot 11 in attempt to unlock the locking device. Thus, the burglarproof effect of the locking device is improved.

The receiving portion 21 may be in the form of a groove that can be used to receive the attachment 3. As such, stable positioning of the attachment 3 can be attained. In the embodiment, the guiding piece 22 is located outside of and adjacent to the receiving portion 21. As such, the guiding piece 22 can block the key slot 11 when the attachment 3 is not received in the receiving portion 21, preventing someone with malicious intention from viewing the internal structure of the lock 1 via the key slot 11, or preventing the insertion of an unlocking tool into the key slot 11 in an attempt to unlock the locking device. Thus, the burglarproof effect of the locking device is improved.

Figure 2:
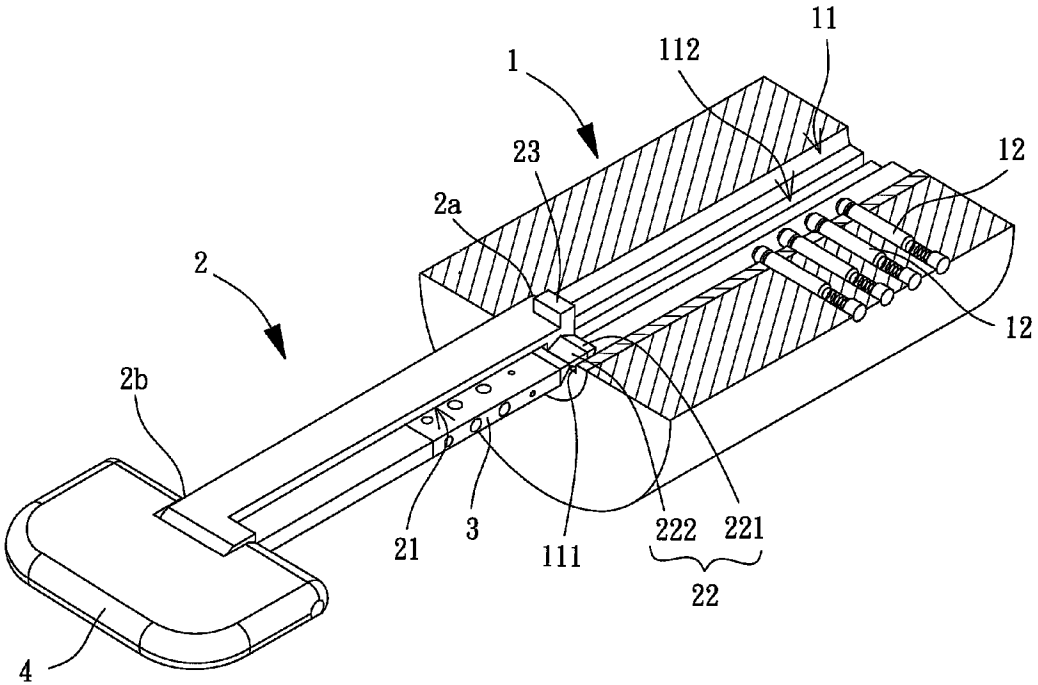
FIG. 2 shows the locking device of the embodiment of the invention where the attachment is attached to the blade.
Figure 3:
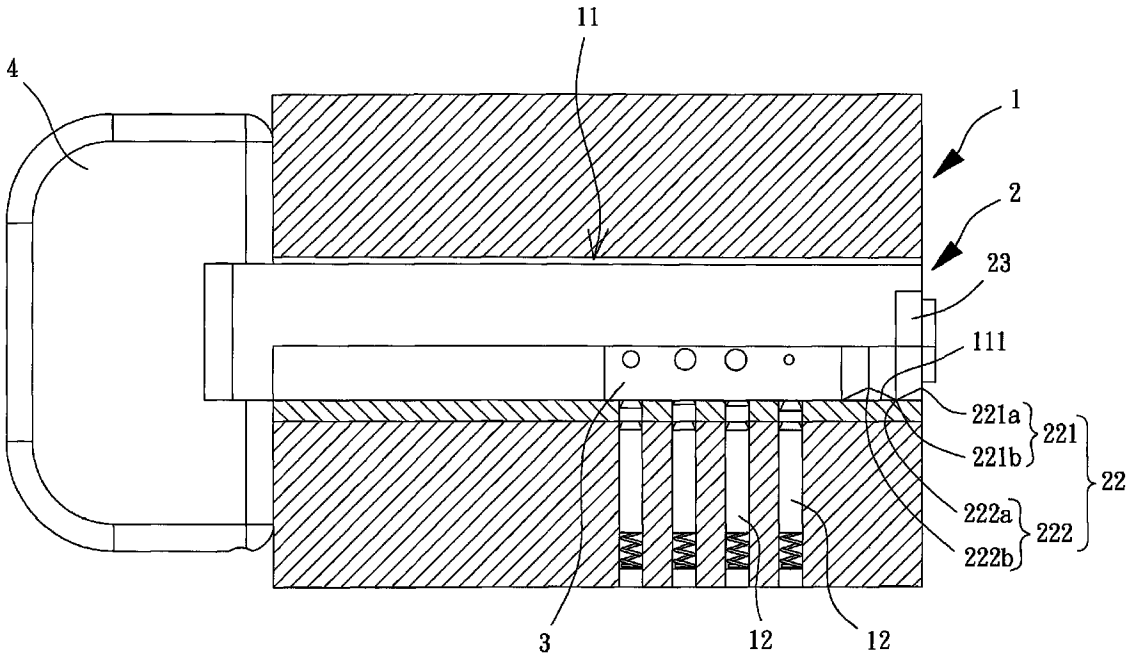
FIG. 3 shows the locking device of the embodiment of the invention where the blade is fully inserted into the lock.
Figure 4:
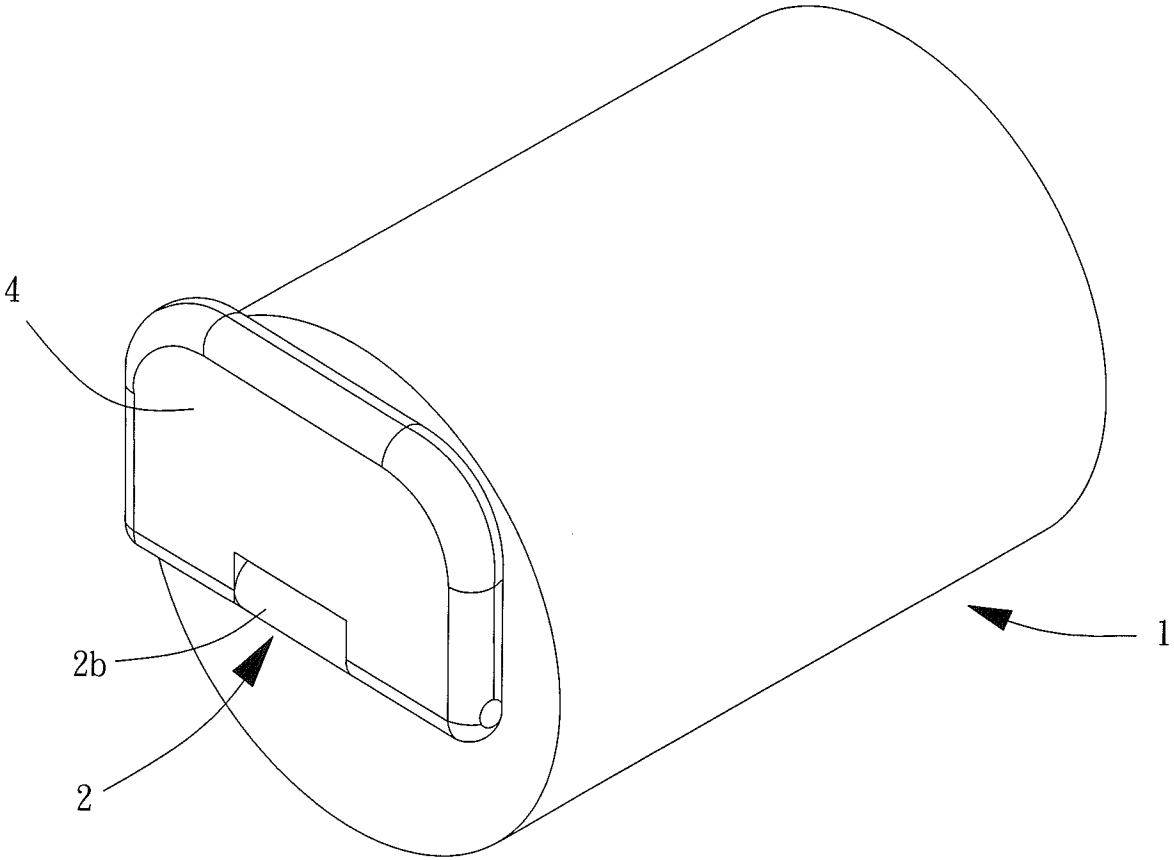
FIG. 4 shows a use of the locking device of the embodiment of the invention.

Referring to FIGS. 1-3, the blade 2 is slid to drive the guiding piece 22 to be in or off contact with the lockpin unit 12. The guiding piece 22 ensures that the blade 2 can smoothly slide through the lockpin unit 12. Specifically, in the embodiment, the guiding piece 22 includes an insertion guiding portion 221. The insertion guiding portion 221 includes a first insertion end 221*a* relatively adjacent to an end face of the guiding end 2*a* perpendicular to the extending direction of the sliding groove 112, as well as a second insertion end 221*b* relatively distant to the end face of the guiding end 2*a*. The first insertion end 221*a* is spaced from the inner wall 111 at a first distance, and the second insertion end 221*b* is spaced from the inner wall 111 at a second distance. The first distance is larger than the second distance. In this arrangement, when the blade 2 is slidably inserted into the key slot 11, the insertion guiding portion 221 can come in contact with the lockpin unit 12 and push the lockpin unit 12 back into the inner wall 111 of the key slot 11. Advantageously, the insertion of the blade 2 is smooth, providing an improved utility of the locking device.

Furthermore, the guiding piece 22 may include a withdrawal guiding portion 222. The withdrawal guiding portion 222 includes a first withdrawing end 222*a* relatively adjacent to the end face of the guiding end 2*a* perpendicular to the extending direction of the sliding groove 112, as well as a second withdrawing end 222*b* relatively distant to the end face of the guiding end 2*a*. The first withdrawing end 222*a* is spaced from the inner wall 111 at a first spacing, and the second withdrawing end 222*b* is spaced from the inner wall 111 at a second spacing. The first spacing is smaller than the second spacing. In this arrangement, when the blade 2 is slidably withdrawn from the key slot 11, the withdrawal guiding portion 222 can come in contact with the lockpin unit 12 and push the lockpin unit 12 back into the inner wall 111 of the key slot 11. Advantageously, the withdrawal of the blade 2 is smooth, providing an improved utility of the locking device.

Moreover, when the sliding groove 112 of the key slot 11 includes the blocker 112*a*, the blade 2 preferably includes a limiting block 23 at the guiding end 2*a*. The quantity of the blocker 112*a* is not limited. In the embodiment, there may be two limiting blocks 23 arranged at two sides of the blade 2, respectively. The blocker 112*a* may have a shape corresponding to the shape of the limiting block 23, as it can be readily appreciated by the skilled persons. Therefore, when the guiding end 2*a* of the blade 2 approaches the blocker 112*a* during the withdrawal of the blade 2, the limiting block 23 may be blocked by the limiting block 23 to prevent disengagement of the blade 2 from the key slot 11. Through the arrangement of the blade 2 and the guiding piece 22, it can prevent someone with malicious intention from viewing the internal structure of the lock 1 via the key slot 11, as well as preventing the insertion of an unlocking tool into the key slot 11 in an attempt to unlock the locking device. Thus, the burglarproof effect of the locking device is improved.

The attachment 3 is detachably attached to the receiving portion 21 of the blade 2. The blade 2 is slid to drive the attachment 3 to be in or off contact with the lockpin unit 12. When the attachment 3 is in contact with the lockpin unit 12, the attachment 3 can switch the lock 1 between a locking state and an unlocking state.

Referring to FIGS. 1-4, the locking device according to the embodiment of the invention preferably further includes a head 4 coupled with the control end 2*b* of the blade 2. In the embodiment, the head 4 is coupled with the control end 2*b* of the blade 2 in a rotatable manner. As such, the user can manually operate the head 4 to move or rotate the blade 2 relative to the lock 1. In addition, when the blade 2 is in the key slot 11, the head 4 can be folded towards the key insertion face of the lock 1 to reduce the entire length of the locking device. Thus, the utility of the locking device is improved.

Overall, when the locking device according to the embodiment of the invention is in use, the attachment 3 may be inserted into the receiving portion 21 of the blade 2. In this regard, the blade 2 can slide into the key slot 11. After the attachment 3 properly abuts against the lockpin unit 12, the blade 2 can be rotated to lock/unlock the lock 1. After the lock 1 is locked by the blade 2, the blade 2 can be slid backwards. The attachment 3 can be removed from the receiving portion 21 when the blade 2 is slid in a location where the attachment 3 is completely outside the key slot 11. Finally, the blade 2 can be slid back into the key slot 11. In such an arrangement, if someone ever tries to view the internal structure of the lock 1, they will not be able to disengage the blade 2 from the key slot 11. Therefore, the blade 2 and the guiding piece 22 will block the key slot 11, preventing viewing of the internal structure of the lock 1 via the key slot 11, as well as preventing the insertion of an unlocking tool into the key slot 11 in an attempt to unlock the locking device. Thus, the burglarproof effect of the locking device is improved.

In summary, since the blade 2 cannot be disengaged from the key slot 11, the blade 2 and the guiding piece 22 will block the key slot 11. As such, it will be difficult to view the internal structure of the lock 1 via the key slot 11, or difficult to insert an unlocking tool into the key slot 11 for unlocking the locking device. Thus, the burglarproof effect of the locking device is improved.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A locking device comprising:

a lock comprising a key slot and a lockpin unit, wherein the key slot extends from a key insertion face to an interior of the lock, wherein the lock comprises an inner wall, and wherein the lockpin unit is in the lock and extends into the key slot from the inner wall of the lock;

a blade slidably received in the key slot and comprising a guiding end, a control end, a receiving portion and a guiding piece, wherein the receiving portion is located between the guiding end and the control end, wherein the guiding piece is arranged at the guiding end, wherein the guiding end is located in the key slot, and wherein the control end is located outside the key slot; and an attachment detachably attached to the receiving portion of the blade, wherein the blade is slideable to drive the attachment to be in or off contact with the lockpin unit, wherein the blade is irremovable from the lock regardless of whether the attachment is attached to the receiving portion of the blade, and wherein the blade is unable to unlock the lock when the attachment is detached from the receiving portion of the blade.

2. The locking device as claimed in claim 1, wherein the lock further comprises a sliding groove, wherein the blade is slidably received in the lock, wherein a blocker is arranged in the sliding groove of the key slot, wherein the blade further comprises a limiting block, and wherein the blocker is configured to abut against the limiting block.

3. The locking device as claimed in claim 2, wherein the blocker is located at one end of the sliding groove adjacent to the key insertion face, and the limiting block is located at the guiding end of the blade.

4. The locking device as claimed in claim 1, wherein the receiving portion is in the form of a groove.

5. The locking device as claimed in claim 1, further comprising a head coupled with the control end of the blade.

6. The locking device as claimed in claim 5, wherein the head is coupled with the control end of the blade in a rotatable manner and is foldable towards the key insertion face of the lock.

7. The locking device as claimed in claim 1, wherein the guiding piece is located outside of and adjacent to the receiving portion of the blade.

8. The locking device as claimed in claim 1, wherein the guiding piece comprises an insertion guiding portion, wherein the insertion guiding portion comprises a first insertion end relatively adjacent to an end face of the guiding end, as well as a second insertion end relatively distant to the end face of the guiding end, wherein the first insertion end is spaced from the inner wall at a first distance, wherein the second insertion end is spaced from the inner wall at a second distance, and wherein the first distance is larger than the second distance.

9. The locking device as claimed in claim 8, wherein the guiding piece comprises a withdrawal guiding portion, wherein the withdrawal guiding portion comprises a first withdrawing end relatively adjacent to the end face of the guiding end, as well as a second withdrawing end relatively distant to the end face of the guiding end, wherein the first withdrawing end is spaced from the inner wall at a first spacing, wherein the second withdrawing end is spaced from the inner wall at a second spacing, wherein the first spacing is smaller than the second spacing, and wherein the second insertion end and the first withdrawing end are located between the first insertion end and the second withdrawing end along a longitudinal axis of the blade.

10. The locking device as claimed in claim 1, wherein the attachment is completely inside the lock when the attachment is in contact with the lockpin unit.

* * * * *